US007438764B1

(12) United States Patent
Hill

(10) Patent No.: US 7,438,764 B1
(45) Date of Patent: Oct. 21, 2008

(54) SPRAY ASSEMBLY FOR PAVING MACHINE

(75) Inventor: F. Ken Hill, Wickenburg, AZ (US)

(73) Assignee: Bearcat Manufacturing, Inc., Wickenburg, AZ (US)

( * ) Notice: Subject to any disclaimer, the term of this patent is extended or adjusted under 35 U.S.C. 154(b) by 553 days.

(21) Appl. No.: 11/193,606

(22) Filed: Jul. 29, 2005

(51) Int. Cl.

| | |
|---|---|
| ***B05B 7/06*** | (2006.01) |
| ***B05B 1/16*** | (2006.01) |
| ***B05B 1/20*** | (2006.01) |
| ***B05C 11/00*** | (2006.01) |

(52) U.S. Cl. ..... 118/313; 118/504; 118/665; 118/684; 239/159; 239/170

(58) Field of Classification Search ..... 118/313, 118/323, 712, 713, 676–687, 665, 504, 505; 404/111; 239/159–176

See application file for complete search history.

(56) References Cited

U.S. PATENT DOCUMENTS

| | | | |
|---|---|---|---|
| 3,120,927 | A | 2/1964 | Holland |
| 3,807,634 | A | 4/1974 | Vogt |
| 4,684,289 | A | 8/1987 | Gnesa |
| 4,793,731 | A | 12/1988 | Gnesa |
| 4,828,429 | A | 5/1989 | Kirchner et al. |
| 4,856,931 | A | 8/1989 | Bollag |

(Continued)

FOREIGN PATENT DOCUMENTS

| | | | |
|---|---|---|---|
| GB | 2 102 865 | A | 2/1983 |
| JP | 10-072805 | | 3/1998 |
| JP | 10-072806 | | 3/1998 |
| JP | 10-147908 | | 6/1998 |

OTHER PUBLICATIONS

English Translated doc of JP-10072805, Mar. 17, 1998.*

*Primary Examiner*—Yewebdar T Tadesse
(74) *Attorney, Agent, or Firm*—Chambliss, Bahner & Stophel, P.C.

(57) ABSTRACT

A spray assembly for applying a fluid material to a surface includes a first spray bar and a second spray bar, each of which is mounted for movement along an axis. Each spray bar includes a plurality of nozzles, each of which is associated with a valve that can be opened or closed. Each nozzle is adapted to dispense a fluid material in a defined spray pattern onto the surface. The nozzles are spaced along the length of the spray bar to which they are attached and disposed above the surface so that the spray pattern from any nozzle on a spray bar does not overlap the spray pattern of a longitudinally adjacent nozzle. The assembly also includes a source of fluid material, and a fluid circuit through which fluid material may be supplied to each of the nozzles. Components of the assembly are also provided for intercepting at least a portion of the spray from a nozzle of the second spray bar to prevent the spray pattern from such nozzle from overlapping with the spray pattern from a nozzle of the first spray bar. A mechanism is also provided for closing the valve associated with a nozzle of the second spray bar. A preferred embodiment of the invention includes a first spray bar having a plurality of nozzle sets and a second spray bar having a plurality of nozzle sets, and a tack application controller for selectively opening and closing the valves associated with the nozzles in each nozzle set depending on the travel speed of the paving machine.

17 Claims, 7 Drawing Sheets

U.S. PATENT DOCUMENTS 4,878,598 A 11/1989 Ruschhaupt, Jr.
4,944,632 A 7/1990 Dillingham
5,131,788 A 7/1992 Hulicsko
5,279,500 A 1/1994 Perrin et al.
5,324,136 A 6/1994 Reymonet et al.
5,337,959 A * 8/1994 Boyd ..... 239/163
5,354,148 A 10/1994 Reymonet
5,549,457 A * 8/1996 Flores et al. ..... 404/84.05
5,851,085 A 12/1998 Campbell
5,957,621 A 9/1999 Clark, Jr. et al.
5,971,294 A 10/1999 Thompson et al.
6,126,088 A 10/2000 Wilger et al.
6,193,166 B1 2/2001 Miller et al.

* cited by examiner

SPRAY ASSEMBLY FOR PAVING MACHINE

FIELD OF THE INVENTION

The present invention relates generally to a spray assembly for attachment to a vehicle for use in applying a fluid substance onto the surface traveled by the vehicle. More particularly, the invention relates to a spray assembly for asphalt emulsion, liquid asphalt or tack material that is attached to a paving machine or finishing machine that is used to apply asphalt onto the base of a road.

BACKGROUND OF THE INVENTION

Paving of roadways with asphalt is generally carried out by an asphalt paving machine and a number of supply trucks or a material transfer vehicle which transport the asphalt from an asphalt production plant to the paving machine. The paving machine generally is self-propelled and driven by a wheeled or tracked drive system. In a common type of paving machine, a hopper is located at the front end of the machine to receive asphalt from a truck, and a conveyor system typically comprised of one or more slat conveyors transfers the asphalt from the hopper to the road bed or other surface to be paved, in one or more windrows. In another type of paving machine, a gravity-feed hopper is mounted so that the asphalt from the hopper is directed to the road bed or other surface to be paved. A transverse distributing auger is mounted near the rear of the machine to distribute the asphalt across the width of the roadway or lane to be paved and to level it. A floating screed located at the rear end of the machine behind the distributing auger compacts the asphalt and forms the asphalt mat.

It is frequently desirable to apply an asphalt emulsion, liquid asphalt or a similar substance (commonly referred to as "tack" or "tack material") to the surface to be paved prior to distributing and compacting the asphalt into a mat to bind the asphalt to the underlying surface. Tack is typically applied just prior to a paving operation by being sprayed onto the surface to be paved from a spray bar extending transversely over the surface. A tack truck operated independently of the paving machine is usually employed for this purpose. The typical tack truck includes a self-propelled chassis on which are mounted a heated tack storage tank and a tack spray assembly. The truck travels in front of the paving machine while applying a layer of tack to the surface to be paved. The truck travels at 5-10 miles per hour, considerably faster than the 30-120 feet per minute operational speed of the paving machine. Consequently, in order to avoid applying an asphalt mat to a surface on which a layer of tack has prematurely cooled by the passage of time (which premature cooling degrades the binding performance of the tack), the truck must stop periodically in order to wait for the slower paving machine. Tack application systems which employ a tack truck are described in U.S. Pat. No. 4,793,731 of Gnesa, U.S. Pat. No. 4,828,429 of Kirchner et al. and U.S. Pat. No. 4,684,289 of Gnesa.

Among the disadvantages attending the use of a separate tack application vehicle is that the paving machine (and perhaps other vehicles) must travel across the surface to which tack has been applied before the asphalt mat is laid down. This disturbs the tack layer on the surface to be paved and transfers the sticky tack material to the wheels, treads or other components of the paving machine. Furthermore, if the tack truck applies a tack layer too far ahead of the paving machine, the tack material can cool before application of the asphalt mat, which degrades its binding characteristics. Finally, the tack truck requires a separate operator from the paving machine, and there are additional costs associated with maintaining and operating the truck.

Consequently, it is also known to modify a paving machine by installing a tack spray assembly in front of the distributing auger, thereby insuring that the applied tack layer is almost immediately covered by the asphalt mat. Paving machines which include such assemblies are described in U.S. Pat. No. 5,131,788 of Hulicsko and U.S. Pat. No. 5,851,085 of Campbell. However, most paving machines include a screed having extensions that permit adjustment of the width of the asphalt mat being applied. Some such extensions can increase the width to be paved from ten feet to twenty feet or more. In such paving machines which include a tack spray assembly, the width of the spray assembly must also be adjustable to permit the application of tack across the entire width to be paved. Generally this is accomplished by providing a pair of parallel spray bars across the width of the machine, which spray bars may be moved with respect to each other to provide tack coverage across the entire width to be paved. One problem with conventional paving machines which include a pair of moveable tack spray bars is that paving a width less than the maximum allowed by the fully-extended spray bars results in an uneven application of tack because of overlap of spray from adjacent nozzles on the spray bar. U.S. Pat. No. 5,354,148 of Reymonet addresses this problem by controlling the opening and closing of the various spray nozzles using a plurality of servo valves. A different solution to this problem is disclosed by Japanese Patent Publication No. 10072805 of Niigata Engineering Company, Ltd., which describes a spray assembly comprising a first spray bar, a second spray bar, and an excess spray collector pan that is affixed to the front of the first spray bar. This collector pan is arranged so as to intersect the spray from the nozzles of the second spray bar when the spray bars are moved so that the spray from one or more nozzles on the second spray bar overlaps the spray from one or more nozzles on the first spray bar. The disadvantage to this arrangement arises from the fact that all of the tack material that is dispensed through a nozzle providing overlapping spray must be collected in the collector pan and pumped back into the system.

It would be advantageous if a spray assembly for a paving machine could be devised that would permit the application of tack material evenly across various widths of paving without the disadvantages of prior systems. It would also be advantageous if such an assembly could permit the application of a consistent and even layer of tack material when the paving machine is operated at various paving speeds.

ADVANTAGES OF THE INVENTION

Among the advantages of a preferred embodiment of the invention is that it provides a spray assembly for a paving machine that permits the application of a consistent and even layer of tack material when the paving machine is operated at various paving speeds and various paving widths. Other advantages and features of this invention will become apparent from an examination of the drawings and the ensuing description.

EXPLANATION OF TECHNICAL TERMS

As used herein, the term "asphalt" refers to a bituminous paving mixture that is comprised of an asphaltic binder and any of various aggregate materials, and which is used for paving purposes.

As used herein, the term "asphalt paving machine", "paving machine" or "paver" refers to a finishing machine for applying asphalt to form an asphalt mat on a roadway, parking lot or similar surface. An asphalt paving machine is typically a self-propelled vehicle having a hopper for receiving asphalt, a distributing auger for distributing the asphalt along the surface to be paved and a floating screed for forming an asphalt mat.

As used herein, the term "asphalt mat" refers to a layer of asphalt such as is applied by an asphalt paving machine to produce a roadway, parking lot or similar surface.

As used herein, the terms "backward", "rear" and similar terms, when used in connection with an asphalt paving machine, a component of such machine or a position or location on or with respect to such a machine, refer to the end of the machine nearest the screed. The terms "forward", "front" and similar terms, when used in connection with such a machine, component, position or location, refer to the end of the machine opposite the rear end.

As used herein, the terms "asphaltic emulsion", "liquid asphalt", "tack" and similar terms refer to a fluid material that is applied onto a surface to be paved with asphalt prior to the distribution and compaction of the asphalt into an asphalt mat.

As used herein, the terms "fluid" and "fluid material" refer to a liquid or liquid-based material that is capable of flowing. As used herein the terms "fluid" and "fluid material" include, but are not limited to, emulsions and suspensions.

As used herein, the term "linear actuator" and similar terms refer to an electric, hydraulic or electro-hydraulic device that generates force which is directed in a straight line. One common example of a linear actuator is a hydraulic cylinder which includes a cylinder, a piston within the cylinder, and a rod attached to the piston. By increasing the pressure within the cylinder on one side of the piston (over that on the opposite side of the piston), the rod will extend from the cylinder or retract into the cylinder.

As used herein, the term "travel speed", when referring to a paving machine, refers to the speed at which the machine travels across a surface to be paved as it applies an asphalt mat to such surface.

SUMMARY OF THE INVENTION

The invention comprises a spray assembly for applying a fluid material to a surface, which assembly includes first and second spray bars that are each mounted for movement along an axis. Each spray bar includes a plurality of nozzles, each of which has a valve associated therewith that can be opened or closed, and each of which is adapted to dispense a fluid material in a defined spray pattern onto the surface. The nozzles on each spray bar are spaced along the length thereof and disposed above the surface so that the spray pattern from any nozzle on the first spray bar does not overlap the spray pattern of a longitudinally adjacent nozzle on the first spray bar, and so that the spray pattern from any nozzle on the second spray bar does not overlap the spray pattern of a longitudinally adjacent nozzle on the second spray bar. The assembly also includes a source of fluid material and a fluid circuit through which fluid material may be supplied to each of the nozzles. The assembly also includes means for intercepting at least a portion of the spray from a nozzle of the second spray bar to prevent the spray pattern from said nozzle from overlapping with the spray pattern from a nozzle of the first spray bar, and means for closing the valve associated with a nozzle of the second spray bar.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which.

DESCRIPTION OF THE PREFERRED EMBODIMENTS OF THE INVENTION

Figure 1:
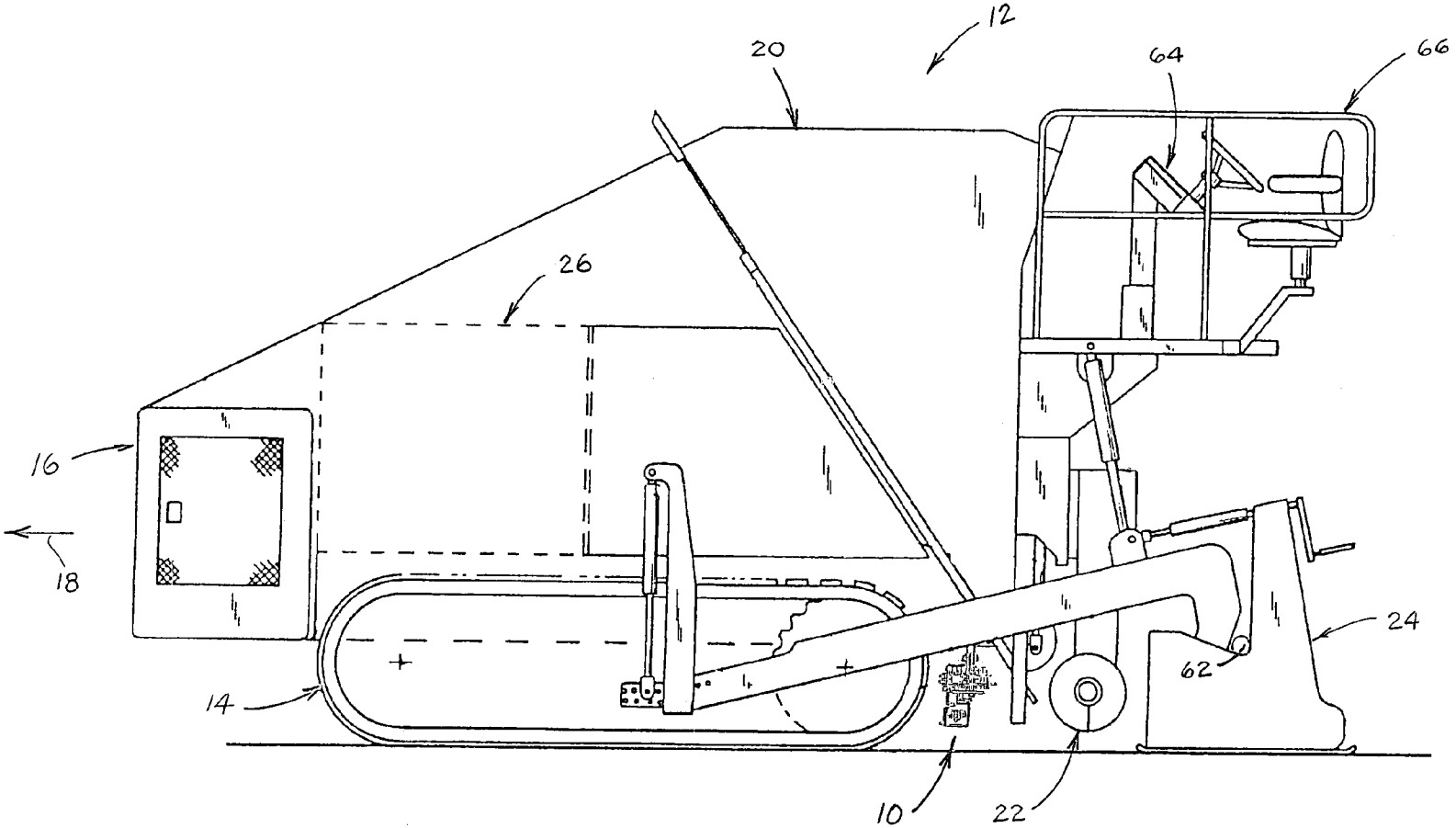
FIG. 1 is a side view of a paving machine to which a preferred embodiment of the invention has been mounted.
Figure 2:
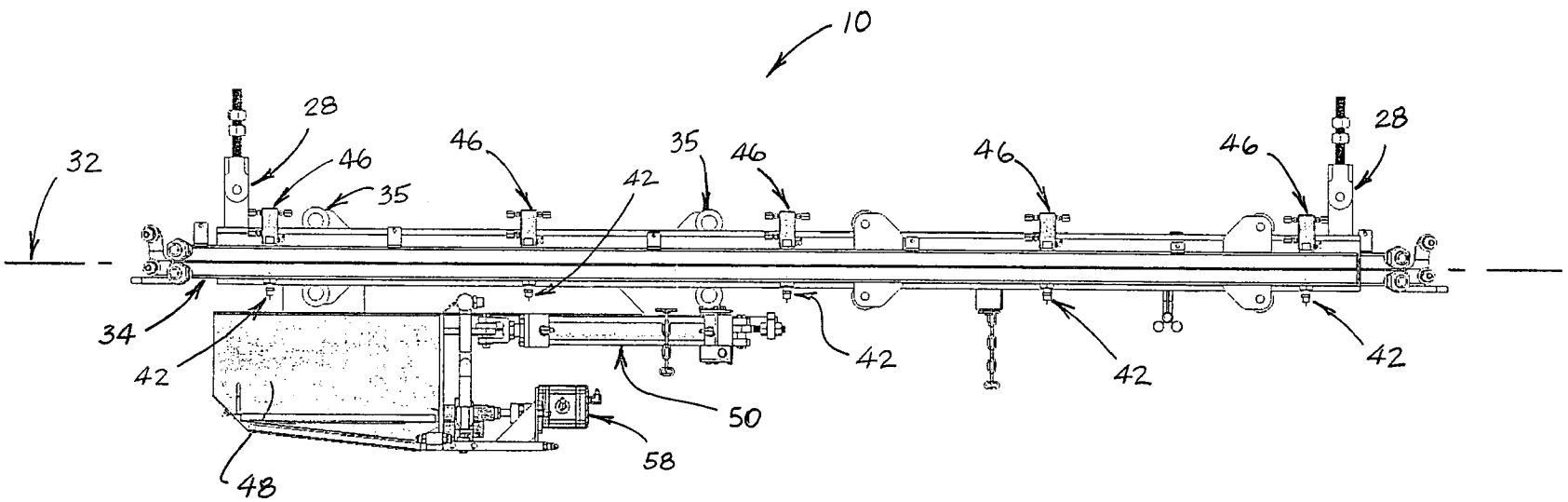
FIG. 2 is a side view of a preferred embodiment of the invention.
Figure 3:
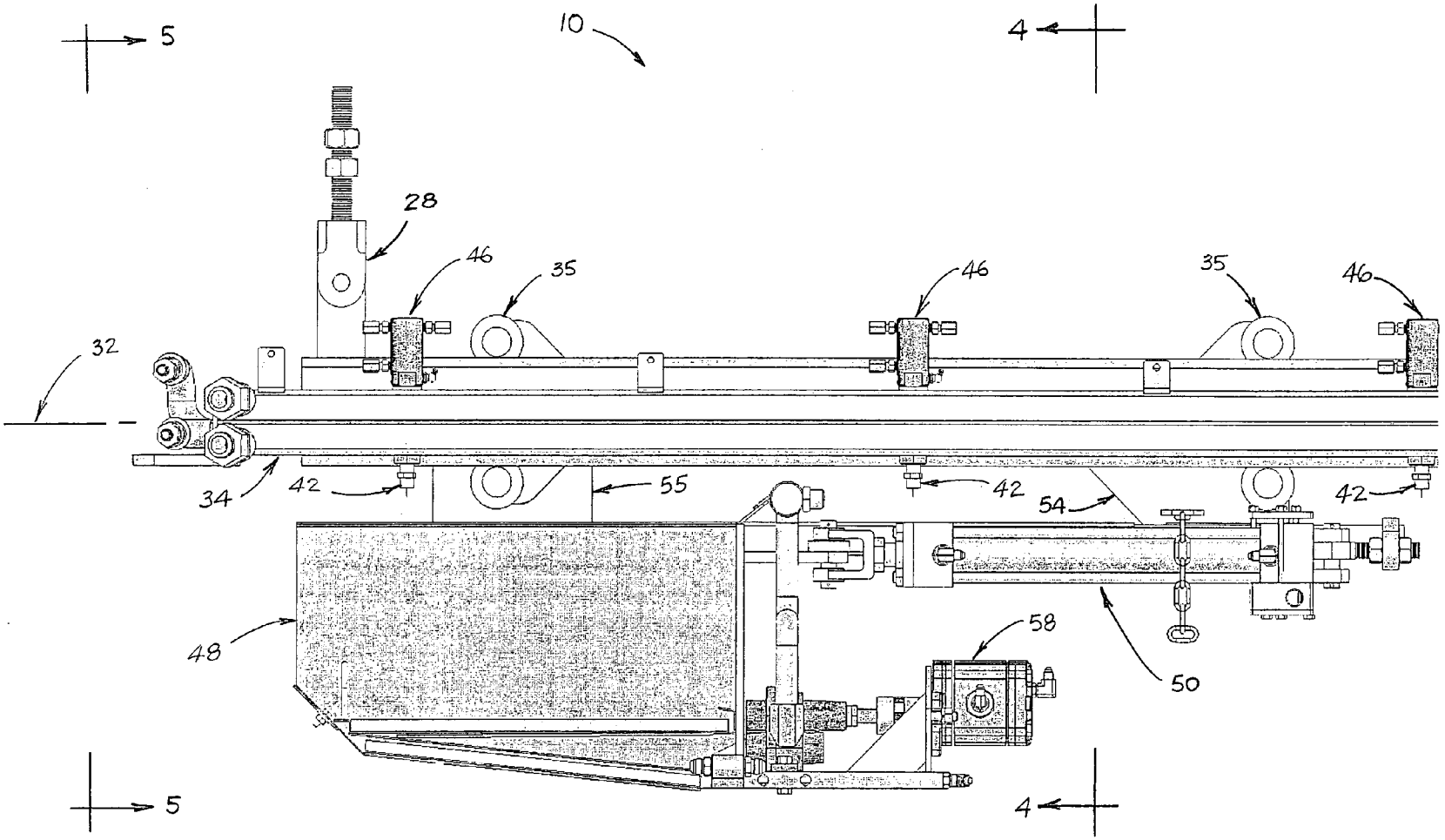
FIG. 3 is an enlarged view of a portion of the embodiment of FIG. 2.

The invention comprises an assembly for applying a spray of tack material to a roadway in conjunction with the operation of a paving machine, and for controlling the spray of tack material onto the surface of the roadway or other surface to be paved. As shown in FIG. 1, spray assembly 10 is adapted to be mounted onto a paving machine such as paving machine 12. Paving machine 12 includes a tracked drive system 14 that is driven by engine 16 so as to move the paving machine during the paving operation in the direction indicated by arrow 18. Paving machine 12 also includes gravity-feed hopper 20 that is mounted so that the asphalt from the hopper is directed to the road bed or other surface to be paved in front of transverse distributing auger 22, which is mounted near the rear of the machine to distribute the asphalt across the width of the roadway or lane to be paved and to level it. Floating screed 24, which is located behind the distributing auger, compacts the asphalt and forms the asphalt mat. Screed 24 includes a conventional screed extension (not shown) on each side to permit adjustment of the width to be paved by the paving machine. Preferably, the screed extensions permit the width to be paved to be adjusted between ten feet (with the extensions fully retracted) and twenty feet (with the extensions fully extended). Paver 12 also includes tack material storage tank (or tack material source) 26, which is connected by a fluid circuit (not shown) to spray assembly 10. As would be appreciated by those having ordinary skill in the art to which the invention relates, the fluid circuit includes a pump and suitable lines or hoses to pump the tack material from the storage tank to the nozzles of the spray assembly.

Referring now to FIGS. 2-6, a preferred embodiment of the spray assembly for applying a fluid material to a surface is shown in more detail. As shown therein, spray assembly 10 includes attachment components 28 for attachment of assembly 10 to a paving machine. Assembly 10 also includes first spray bar 30 that is mounted for movement along axis 32 (shown in FIGS. 2 and 3) which is transverse to paving direction 18 of paver 12, and second spray bar 34 that is also mounted for movement along axis 32. Preferably, the first and second spray bars are attached to the screed extensions of the paving machine (not shown) so that extending or retracting the screed extensions to increase or decrease the width to be paved by the paving machine will automatically adjust the relative positions of the first and second spray bars so that they extend across the same width as the screed (or the extended screed). It is also preferred that spray assembly 10 includes a plurality of roller assemblies 35 by which the first and second spray bars may be securely moved with respect to each other as the screed extensions are extended or retracted.

Figure 7:
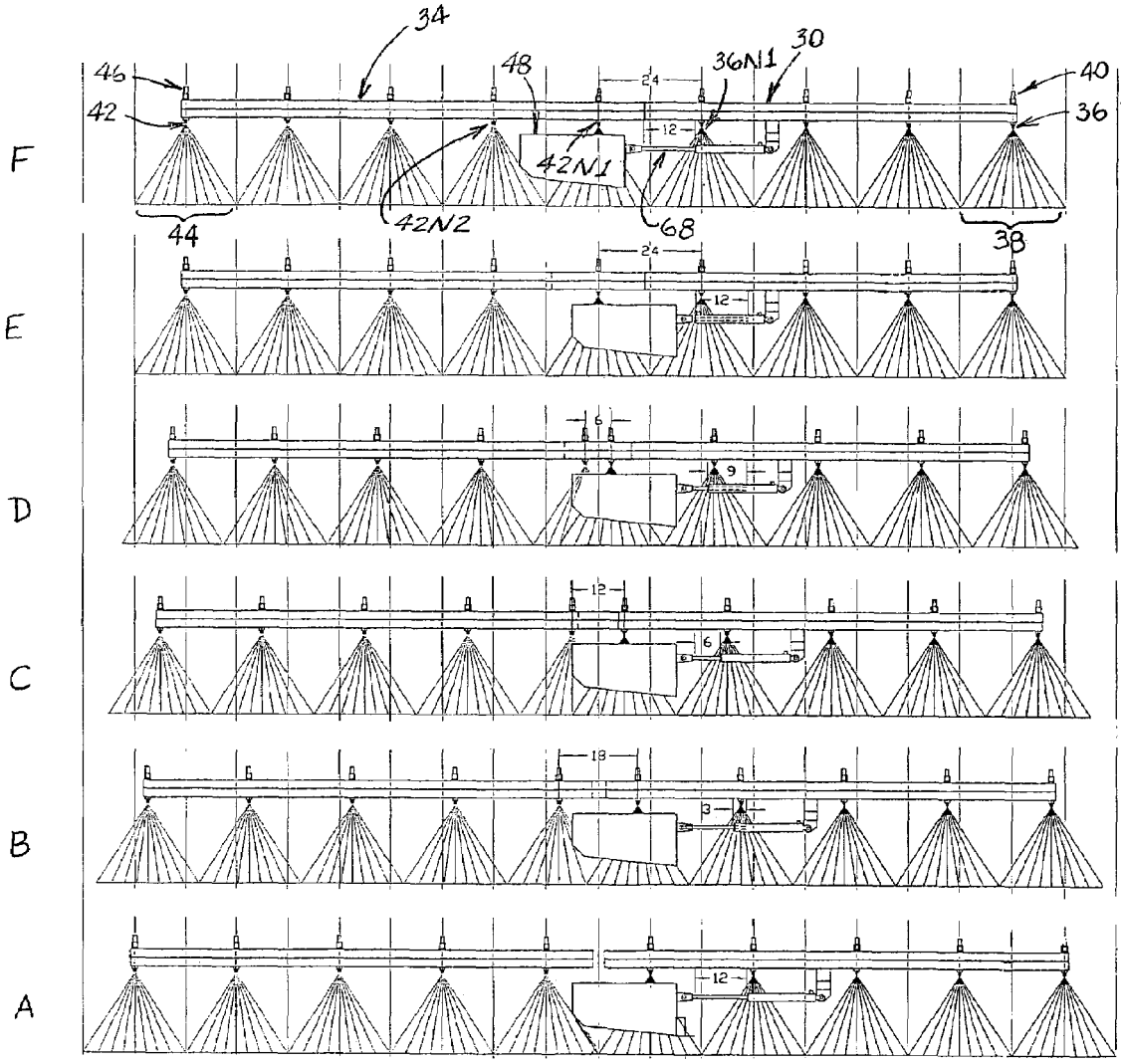
FIGS. 7A-7F are schematic illustrations of exemplary spray patterns of a preferred embodiment of the invention, along the width to be paved, showing the locations of the components of the preferred embodiment at various positions depending on the total length of the spray assembly.

Preferred first spray bar 30 includes five nozzle sets 36 that are preferably spaced 24 inches apart along the length of the spray bar. As shown schematically in FIG. 7F, for example, nozzle sets 36 are spaced along the length of spray bar 30 and disposed above the surface so that the spray pattern 38 from any nozzle set of the first spray bar does not overlap the spray pattern of a longitudinally adjacent nozzle set of the first spray bar. Although five nozzle sets at 24-inch spacing are preferred for the first spray bar, any convenient number and spacing of nozzle sets is contemplated by the invention, so long as longitudinally adjacent spray patterns on the first spray bar do not overlap. It is also preferred that the same spacing be maintained between each pair of longitudinally adjacent nozzle sets on the first spray bar.

Figure 4:
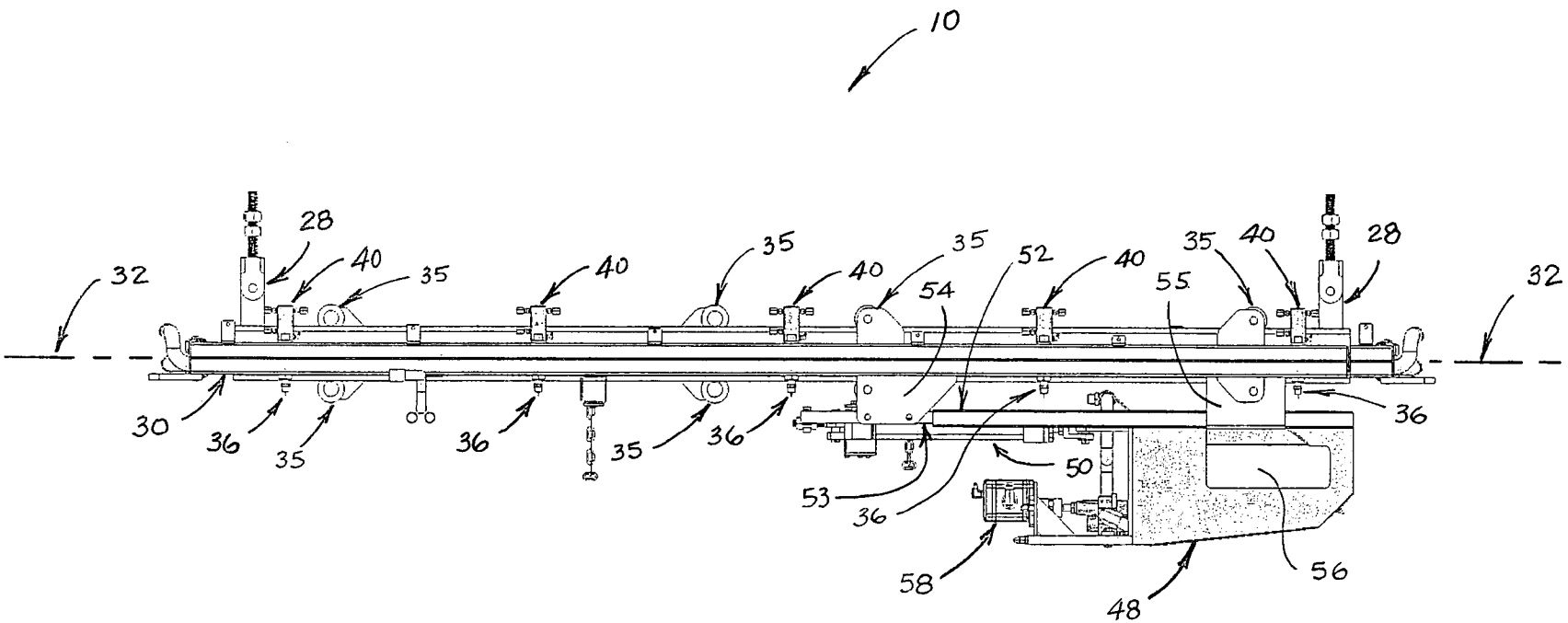
FIG. 4 is an opposite side view of the embodiment of FIGS. 2 and 3.
Figure 5:
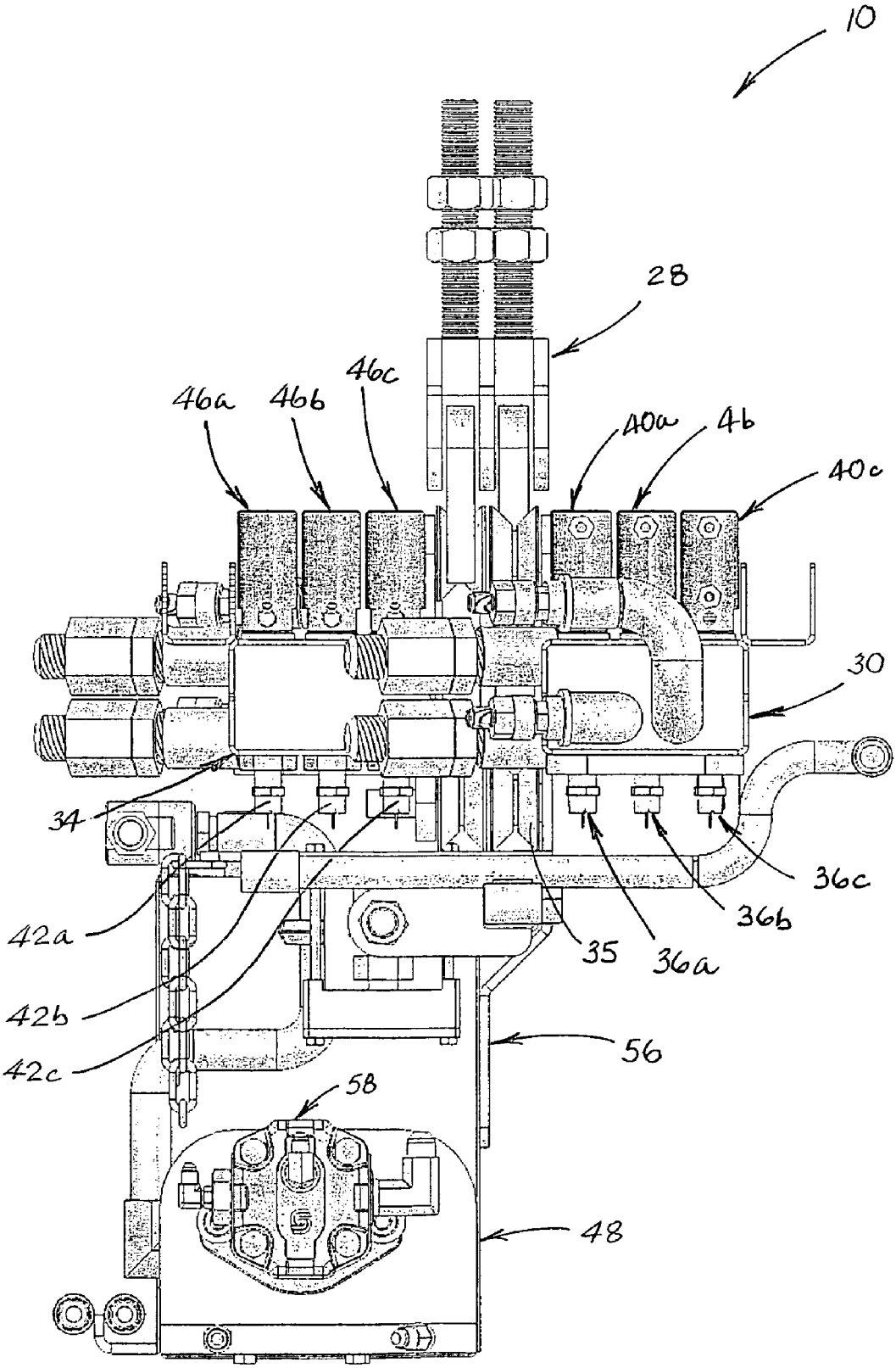
FIG. 5 is an end view of the embodiment of the invention illustrated in FIG. 3, taken along the line 3-3 of FIG. 3.
Figure 6:
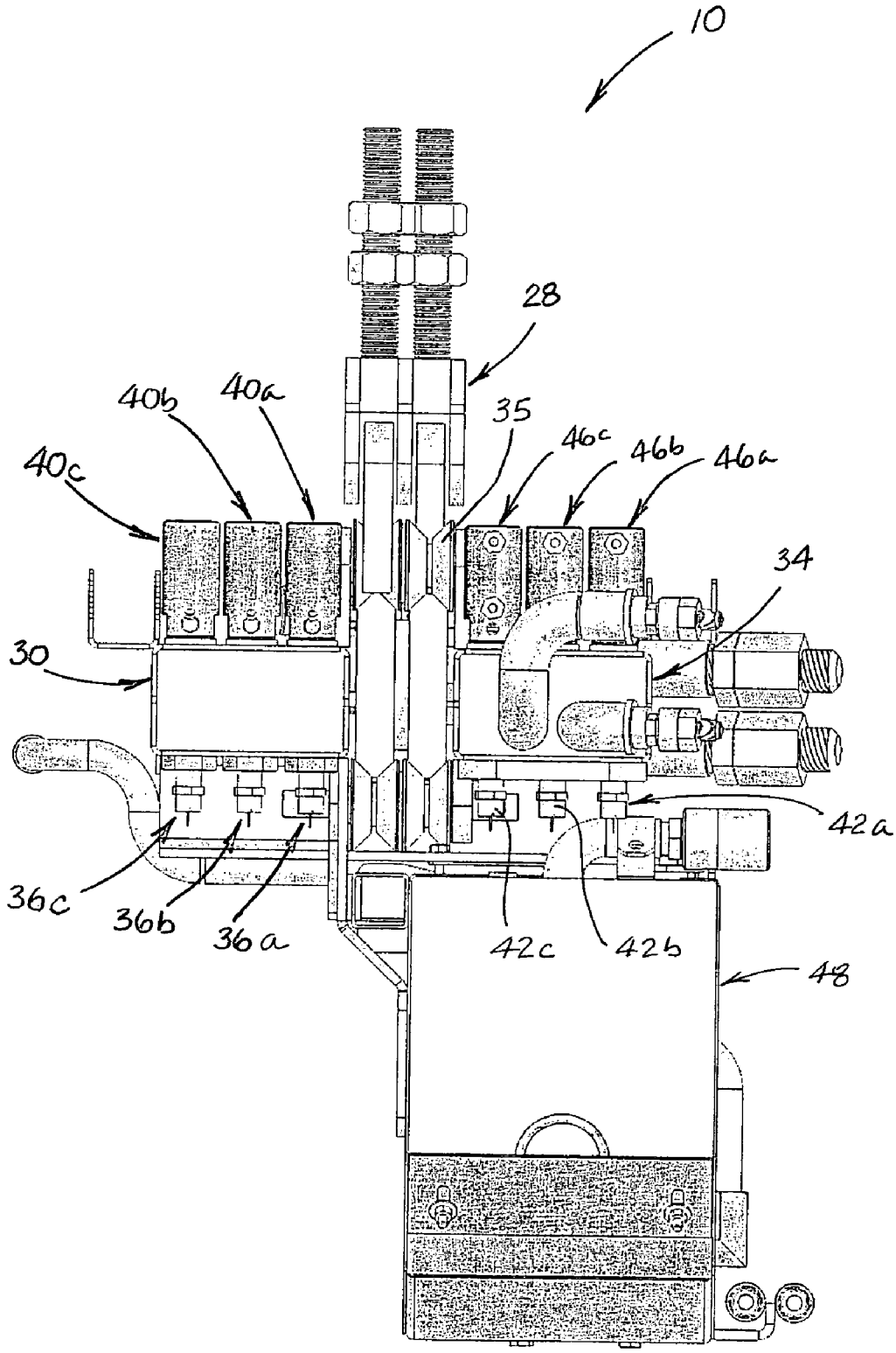
FIG. 6 is an end view of the embodiment of the invention illustrated in FIG. 3, taken along the line 4-4 of FIG. 3.
Figure 8:
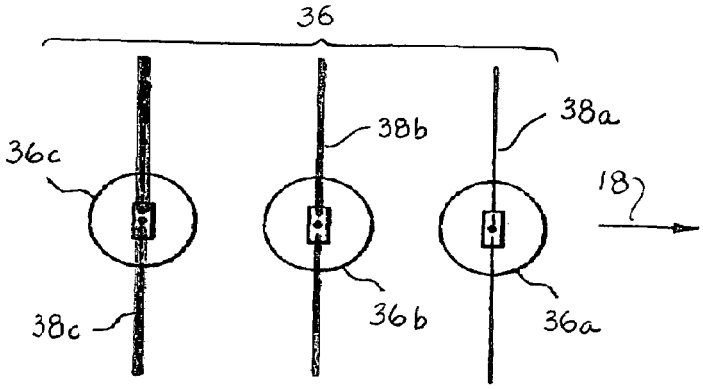
FIG. 8 is a schematic illustration of the spray patterns obtained from the three nozzles of a nozzle set in a preferred embodiment of the invention.

As shown in FIGS. 5, 6 and 8, each nozzle set 36 of first spray bar 30 includes a first nozzle 36*a* which is adapted to dispense a fluid material in a first spray pattern 38*a* onto the surface, second nozzle 36*b* which is adapted to dispense a fluid material in a second spray pattern 38*b* onto the surface, and third nozzle 36*c* which is adapted to dispense a fluid material in a third spray pattern 38*c* onto the surface. As illustrated schematically in FIG. 8, preferred nozzle 36*a* is adapted to dispense fluid material in a lighter spray pattern 38*a* than that of preferred nozzles 36*b* and 36*c*, and preferred nozzle 36*b* is adapted to dispense fluid material in a lighter spray pattern 38*b* than that of preferred nozzle 36*c*. Also, as shown in FIGS. 2-8, nozzles 36*b* and 36*c* are disposed directly behind nozzle 36*a* in each nozzle set 36.

Each first nozzle 36*a* in a nozzle set 36 on the first spray bar has a first valve 40*a* associated therewith that can be opened or closed. Similarly, each second nozzle 36*b* in a nozzle set 36 has a second valve 40*b* associated therewith that can be opened or closed, and each third nozzle 36*c* in a nozzle set 36 has a third valve 40*c* associated therewith that can be opened or closed. Each valve associated with a nozzle in a nozzle set 36 is attached to source 26 of tack material by a fluid circuit (not shown) through which tack material may be supplied to each of the nozzles of the nozzle set of the first spray bar.

Preferred second spray bar 34 also includes five nozzle sets 42 that are also preferably spaced 24 inches apart along the length of the spray bar. As shown schematically in FIG. 7F, for example, nozzle sets 42 are spaced along the length of spray bar 34 and disposed above the surface so that the spray pattern 44 from any nozzle set of the second spray bar does not overlap the spray pattern of a longitudinally adjacent nozzle set of the second spray bar. Although five nozzle sets at 24-inch spacing are preferred for the second spray bar, any convenient number and spacing of nozzle sets is contemplated by the invention, so long as longitudinally adjacent spray patterns on the second spray bar do not overlap. Consequently, it is preferred that the same spacing be maintained between each pair of longitudinally adjacent nozzle sets on the second spray bar. It is also preferred that the spacing between the nozzle sets of the second spray bar be equal to the spacing between the nozzle sets of the first spray bar.

As shown in FIGS. 5 and 6, each nozzle set 42 of second spray bar 34 includes a first nozzle 42*a*, a second nozzle 42*b* and a third nozzle 42*c*. As shown in FIGS. 2-7, nozzles 42*b* and 42*c* are disposed directly behind nozzle 42*a* in each nozzle set 42. Nozzle 42*a* of each nozzle set 42 is adapted to dispense a fluid material in a first spray pattern onto the surface, similar to first spray pattern 38*a* of first nozzle 36*a* of nozzle set 36 on the first spray bar (see FIG. 8). Similarly, second nozzle 42*b* is adapted to dispense a fluid material in a second spray pattern onto the surface, similar to second spray pattern 38*b* of second nozzle 36*b* of nozzle set 36 on the first spray bar. In addition, third nozzle 42*c* is adapted to dispense a fluid material in a third spray pattern onto the surface, similar to third spray pattern 38*c* of third nozzle 36*c* of nozzle set 36 on the first spray bar. In a manner that is similar to the spray patterns 38*a*, 38*b* and 38*c* that are illustrated schematically in FIG. 8, preferred nozzle 42*a* is adapted to dispense fluid material in a lighter spray pattern than that of preferred nozzles 42*b* and 42*c*, and preferred nozzle 42*b* is adapted to dispense fluid material in a lighter spray pattern than that of preferred nozzle 42.

Each first nozzle 42*a* in a nozzle set 42 on the second spray bar has a first valve 46*a* associated therewith that can be opened or closed. Similarly, each second nozzle 42*b* in a nozzle set 42 has a second valve 46*b* associated therewith that can be opened or closed, and each third nozzle 42*c* in a nozzle set 42 has a third valve 46*c* associated therewith that can be opened or closed. Each valve associated with a nozzle in a nozzle set 42 is attached to storage tank (or source) 26 of tack material by a fluid circuit (not shown) through which tack material may be supplied to each of the nozzles of the second nozzle set.

Assembly 10 also includes means for intercepting at least a portion of the spray from a nozzle set of the second spray bar (such as the one that is marked 42N in FIG. 7F) to prevent the spray pattern from said nozzle set from overlapping with the spray pattern from a nozzle set of the first spray bar (such as the one that is marked 36N in FIG. 7F). Such means preferably includes a collector pan 48 that is mounted for linear movement along the first spray bar by means of linear actuator 50. Preferably, as best shown in FIG. 4, collector pan 48 is mounted onto tube 52 which mounts over and is adapted to slide along tube 53. Tube 53 is attached to bracket 54, and bracket 54 is attached to spray bar 30. Bracket 55 is attached to first spray bar 30 and includes extended portion 56 which helps to maintain the collector pan in the proper orientation as it moves along spray bar 30 under the influence of linear actuator 50. The linear actuator is fixedly attached to spray bar 30 by bracket 54. As the linear actuator extends and retracts, the cooperation of telescoping tubes 52 and 53 allows the collector pan to move along spray bar 30. In a preferred embodiment of the invention, the collector pan has a length (measured along the spray bar) that is approximately equal to the spacing between the nozzle sets of the first and second spray bars.

The preferred embodiment of assembly 10 includes a control mechanism that is operatively connected to the linear actuator in order to move the collector pan (as shown in FIGS.

7A-7F) so that it intercepts at least a portion of the spray from a nozzle set of the second spray bar (such as nozzle 42N in FIG. 7F) to prevent the spray pattern from said nozzle from overlapping with the spray pattern from a nozzle set of the first spray bar (such as nozzle 36N in FIG. 7F). This preferred control mechanism includes a first sensor for detecting the relative position of the first spray bar with respect to the second spray bar. Preferably, this first sensor is a linear potentiometer 62 (see FIG. 1) that is attached to the screed of the paver and adapted to accurately measure the total length of the screed (including extensions), which length corresponds (in the preferred embodiment) with the total or combined (extended or retracted) length of the first and second spray bars. It is also preferred that this linear potentiometer is operably connected to an overspray controller such as microprocessor 64 (shown in FIG. 1) that is located in operator's station 66 of the paving machine. It is also preferred that the linear actuator includes or is associated with a second sensor for detecting the relative position of the collector pan on the first spray bar. Preferably, this sensor comprises a second linear potentiometer (that is preferably internal to the linear actuator) which can measure the length by which rod 68 of the actuator (see FIG. 7F) is extended or retracted to move the collector pan along first spray bar 30. The second sensor is also operably connected to microprocessor 64 in order to move the collector pan so that it intercepts at least a portion of the spray from the a nozzle set of the second spray bar to prevent the spray pattern from said nozzle from overlapping with the spray pattern from a nozzle set of the first spray bar, as shown in FIGS. 7A-7F.

FIG. 7A illustrates the maximum displacement or extension of the spray bars with respect to each other. In this configuration of the invention, there is no overlapping of the spray bars and no overlapping of spray patterns between a nozzle set of the second spray bar and a nozzle set of the first spray bar. In this configuration, the rod of the linear actuator attached to the collector pan is fully extended (preferably by twelve inches), but the collector pan does not intercept any part of the spray from any nozzle set of the second spray bar. In FIG. 7B, the total length of the preferred spray assembly is reduced by six inches from its maximum; there is a slight overlap of the first and second spray bars, and the rod of the linear actuator for the preferred collector pan is extended by nine inches. In this configuration, it can be seen that the collector pan intercepts a portion of the spray from the nozzle set of the second spray bar that is marked as nozzle set 42N1 in FIG. 7F in order to prevent it from overlapping with the spray pattern from the nozzle set of the first spray bar that is marked as nozzle set 36N1. In FIG. 7C, the total length of the spray assembly is reduced by twelve inches from its maximum and the rod of the linear actuator for the preferred collector pan is extended by six inches. In this configuration, it can be seen that the collector pan intercepts a somewhat larger portion of the spray from the nozzle set of the second spray bar that is marked as nozzle set 42N1 in FIG. 7F in order to prevent it from overlapping with the spray pattern from the nozzle set of the first spray bar that is marked as nozzle set 36N1. In FIG. 7D, the total length of the spray assembly is reduced by eighteen inches from its maximum and the rod of the linear actuator for the preferred collector pan is extended by three inches. In this configuration, it can be seen that the collector pan intercepts most of the spray from the nozzle set of the second spray bar that is marked as nozzle set 42N1 in FIG. 7F in order to prevent it from overlapping with the spray pattern from the nozzle set of the first spray bar that is marked as nozzle set 36N1. In FIG. 7E, the total length of the spray assembly is reduced by twenty-four inches from its maximum and the rod of the linear actuator for the preferred collector pan is fully retracted. In this configuration, it can be seen that the collector pan intercepts all of the spray from the nozzle set of the second spray bar that is marked as nozzle set 42N1 in FIG. 7F in order to prevent such spray from overlapping with the spray pattern from the nozzle set of the first spray bar that is marked as nozzle set 36N1. When this condition is obtained, it is preferred that microprocessor 64 be operatively connected to the valves associated with the second nozzle set of the second spray bar that is nearest the first spray bar in order to serve as a means for closing such valves. Closing of these valves prevents the further spray of tack material (from nozzle set 42N1) that will have to be collected in the collector pan and pumped to the storage tank by pump 58. FIG. 7F shows that when these valves are closed, it is preferred that the rod of linear actuator 50 be extended to the fully extended position of FIG. 7A. Further reductions in the relative displacement or extension of the first and second spray bars with respect to each other can result in additional overlap between the spray bars, in a manner similar to that illustrated in FIGS. 7A-7F. Thus, for example, reducing the total length of the spray assembly by an additional six inches (or by a total of thirty inches) and extending the rod of the linear actuator for the preferred collector pan by nine inches (similar to that shown in FIG. 7B) will position the collector pan so that it intercepts a portion of the spray from the nozzle set of the second spray bar that is marked as nozzle set 42N2 in FIG. 7F in order to prevent it from overlapping with the spray pattern from the nozzle set of the first spray bar that is marked as nozzle set 36N1. In this configuration, the microprocessor will operate to close the valves associated with the nozzle set that is marked as nozzle set 42N1 in FIG. 7F so that only the spray from the nozzle set marked as nozzle set 42N2 is collected by the collector pan to be pumped back to the storage tank. A further reduction in the total length of the spray assembly by an additional six inches (or by a total of thirty-six inches) and extension of the rod of the linear actuator for the preferred collector pan by six inches (similar to that shown in FIG. 7C) will position the collector pan so that it intercepts a larger portion of the spray from the nozzle set of the second spray bar that is marked as nozzle set 42N2 in FIG. 7F in order to prevent it from overlapping with the spray pattern from the nozzle set of the first spray bar that is marked as nozzle set 36N1. Further reductions in the total length of the spray assembly can be accompanied by the closing of the valves associated with additional nozzle sets on the second spray bar and by positioning of the collector pan in a manner similar to that shown in FIGS. 7A-7F, in order to prevent the spray patterns from nozzle sets of the second spray bar from overlapping with the spray pattern from a nozzle set of the first spray bar. Of course, it is within the scope of the invention to reduce total maximum length of the spray assembly by any convenient amount (other than as shown in FIGS. 7A-7F) in order to accommodate a desired paving width, and the rod of linear actuator 50 can be extended or retracted by an appropriate amount, as would be appreciated by those having ordinary skill in the art to which the invention relates, to prevent the spray patterns from nozzle sets of the second spray bar from overlapping with the spray pattern from a nozzle set of the first spray bar. At the minimum extension of the spray assembly, the first and second spray bars will entirely overlap and the microprocessor will close all of the valves associated with the nozzle sets of the second spray bar.

The preferred embodiment of the invention also includes means for selectively opening and closing the valves associated with the nozzles of each nozzle set. Preferably, a tack application controller comprising microprocessor 64 is operatively connected to each of the valves associated with the nozzles of each nozzle set, as well as to a speed sensor (not shown) for measuring the travel speed of the paving machine. In such circumstance, it is also preferred that each nozzle set includes a first nozzle which is adapted to dispense a fluid material in a first spray pattern onto the surface, a second nozzle which is adapted to dispense a fluid material in a second spray pattern onto the surface, and third nozzle which is adapted to dispense a fluid material in a third spray pattern onto the surface. It is also preferred, as described above in connection with the description of FIG. 8, that the first nozzle in a nozzle set be adapted to dispense tack material in a lighter spray pattern than that of the second and third nozzles of the set, and that the second nozzle in the set be adapted to dispense tack material in a lighter spray pattern than that of the third nozzle in the set. It is also preferred that the second and third nozzles in each set be disposed directly behind the first nozzle in such set. Depending on the travel speed of the paving machine and the desired level of tack application, the tack application controller may: (a) open all of the valves associated with the first nozzle of each nozzle set and close all of the valves associated with the second and third nozzles of each nozzle set; or (b) open all of the valves associated with the second nozzle of each nozzle set and close all of the valves associated with the first and third nozzles of each nozzle set; or (c) open all of the valves associated with the third nozzle of each nozzle set and close all of the valves associated with the first and second nozzles of each nozzle set; or (d) open all of the valves associated with the first and second nozzles of each nozzle set and close all of the valves associated with the third nozzles of each nozzle set; or (e) open all of the valves associated with the first and third nozzles of each nozzle set and close all of the valves associated with the second nozzles of each nozzle set; or (f) open all of the valves associated with the second and third nozzles of each nozzle set and close all of the valves associated with the first nozzles of each nozzle set; or (g) open all of the valves associated with the first, second and third nozzles of each nozzle set. By varying the opening and closing of the valves in this manner, the preferred assembly can be operated to control the application of tack material at a desired rate, regardless of the travel speed of the paver.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations, and the same are intended to be comprehended within the meaning and range of equivalents of the appended claims.

What is claimed is:

1. A spray assembly for applying a fluid material to a surface, said assembly comprising:

(a) a first spray bar that is mounted for movement along an axis, said spray bar including a plurality of nozzles:
  (i) each of which has a valve associated therewith that can be opened or closed;
  (ii) each of which is adapted to dispense a fluid material in a defined spray pattern onto the surface;
  (iii) which are spaced along the length thereof and disposed above the surface so that the spray pattern from any nozzle of the first spray bar does not overlap the spray pattern of a longitudinally adjacent nozzle of the first spray bar;

(b) a second spray bar that is mounted for movement along the axis, said spray bar including a plurality of nozzles:
  (i) each of which has a valve associated therewith that can be opened or closed;
  (ii) each of which is adapted to dispense a fluid material in a defined spray pattern onto the surface;
  (iii) which are spaced along the length thereof and disposed above the surface so that the spray pattern from any nozzle of the second spray bar does not overlap the spray pattern of a longitudinally adjacent nozzle of the second spray bar;

(c) a source of fluid material;

(d) a fluid circuit through which fluid material may be supplied to each of the nozzles of the first spray bar and each of the nozzles of the second spray bar;

(e) means for intercepting at least a portion of the spray from a nozzle of the second spray bar to prevent the spray pattern from said nozzle of the second spray bar from overlapping with the spray pattern from a nozzle of the first spray bar; and (f) means for closing the valve associated with a nozzle of the second spray bar.

2. The spray assembly of claim 1 wherein the means for closing the valve associated with a nozzle of the second spray bar comprises a microprocessor that is operatively connected to such valve and adapted to close it.

3. A spray assembly for applying a fluid material to a surface, said assembly comprising:

(a) a first spray bar that is mounted for movement along an axis, said spray bar including a plurality of nozzles:
  (i) each of which has a valve associated therewith that can be opened or closed;
  (ii) each of which is adapted to dispense a fluid material in a defined spray pattern onto the surface;
  (iii) which are spaced along the length thereof and disposed above the surface so that the spray pattern from any nozzle of the first spray bar does not overlap the spray pattern of a longitudinally adjacent nozzle of the first spray bar;

(b) a second spray bar that is mounted for movement along the axis, said spray bar including a plurality of nozzles:
  (i) each of which has a valve associated therewith that can be opened or closed;
  (ii) each of which is adapted to dispense a fluid material in a defined spray pattern onto the surface;
  (iii) which are spaced along the length thereof and disposed above the surface so that the spray pattern from any nozzle of the second spray bar does not overlap the spray pattern of a longitudinally adjacent nozzle of the second spray bar:

(c) a source of fluid material;

(d) a fluid circuit through which fluid material may be supplied to each of the nozzles of the first spray bar and each of the nozzles of the second spray bar;

(e) means for intercepting at least a portion of the spray from a nozzle of the second spray bar to prevent the spray pattern from said nozzle of the second spray bar from overlapping with the spray pattern from a nozzle of the first spray bar, said means comprising:
  (1) a collector pan that is mounted for linear movement along the first spray bar under a nozzle of the second spray bar;
  (2) a linear actuator for moving the collector pan along at least a portion of the first spray bar;
  (3) a control mechanism that is operatively connected to the linear actuator in order to move the collector pan so that it intercepts at least a portion of the spray from the nozzle of the second spray bar to prevent the spray pattern from said nozzle of the second spray bar from overlapping with the spray pattern from a nozzle of the first spray bar; and (f) means for closing the valve associated with a nozzle of the second spray bar.

4. The spray assembly of claim 3 wherein:

(a) the nozzles of the second spray bar are spaced along the second spray bar by an equal spacing amount;

(b) the collector pan has a length measured along the first spray bar that is approximately equal to the spacing amount of the nozzles of the second spray bar.

5. The spray assembly of claim 3 which includes a pump mounted on the collector pan and fluid circuitry between the pump and the source of fluid material, said pump being adapted to pump fluid material collected in the collector pan back to the source.

6. The spray assembly of claim 3, wherein the control mechanism comprises:

(a) a first sensor for detecting the relative position of the first spray bar with respect to the second spray bar;

(b) a second sensor for detecting the relative position of the collector pan on the first spray bar;

(c) an overspray controller that is operatively connected to the linear actuator in order to move the collector pan so that it intercepts at least a portion of the spray from a nozzle of the second spray bar to prevent the spray pattern from said nozzle of the second spray bar from overlapping with the spray pattern from a nozzle of the first spray bar.

7. The spray assembly of claim 3, wherein the control mechanism comprises:

(a) a first sensor for detecting the relative position of the first spray bar with respect to the second spray bar;

(b) a second sensor for detecting the relative position of the collector pan on the first spray bar;

(c) a microprocessor:

(i) that is operatively connected to the linear actuator in order to move the collector pan so that it intercepts at least a portion of the spray from a nozzle of the second spray bar to prevent the spray pattern from said nozzle of the second spray bar from overlapping with the spray pattern from a nozzle of the first spray bar; and (ii) that is operatively connected to the valve associated with a nozzle of the second spray bar in order to close said valve.

8. A spray assembly for applying a fluid material to a surface, said assembly comprising:

(a) a first spray bar that is mounted for movement along an axis, said spray bar including a plurality of nozzle sets:

(i) each of which includes a first nozzle which is adapted to dispense a fluid material in a first pattern onto the surface, said first nozzle having a valve associated therewith that can be opened or closed;

(ii) each of which includes a second nozzle which is adapted to dispense a fluid material in a second pattern onto the surface, said second nozzle being disposed behind the first nozzle and having a valve associated therewith that can be opened or closed;

(iii) which are spaced along the length thereof and disposed above the surface so that the spray pattern from any nozzle set of the first spray bar does not overlap the spray pattern of a longitudinally adjacent nozzle set of the first spray bar;

(b) a second spray bar that is mounted for movement along the axis, said spray bar including a plurality of nozzle sets:

(i) each of which includes a first nozzle which is adapted to dispense a fluid material in a first pattern onto the surface, said first nozzle having a valve associated therewith that can be opened or closed;

(ii) each of which includes a second nozzle which is adapted to dispense a fluid material in a second pattern onto the surface, said second nozzle being disposed behind the first nozzle and having a valve associated therewith that can be opened or closed;

(iii) which are spaced along the length thereof and disposed above the surface so that the spray pattern from any nozzle set of the second spray bar does not overlap the spray pattern of a longitudinally adjacent nozzle set of the second spray bar;

(c) a source of fluid material;

(d) a fluid circuit through which fluid material may be supplied to each of the nozzles of the nozzle sets of the first spray bar and each of the nozzles of the nozzle sets of the second spray bar;

(e) means for intercepting at least a portion of the spray from a nozzle set of the second spray bar to prevent the spray pattern from said nozzle set of the second spray bar from overlapping with the spray pattern from a nozzle set of the first spray bar; and (f) means for closing the valves associated with the nozzles of a nozzle set of the second spray bar;

(g) means for selectively opening or closing the valves associated with the nozzles of each nozzle set.

9. The spray assembly of claim 8 wherein the means for closing the valves associated with a nozzle set of the second spray bar comprises a microprocessor that is operatively connected to such valves and adapted to close them.

10. The spray assembly of claim 8 wherein the means for selectively opening and closing the valves associated with the nozzles of each nozzle set comprises a tack application controller that is adapted to:

(a) open all of the valves associated with the first nozzle of each nozzle set and close all of the valves associated with the second nozzle of each nozzle set; or (b) open all of the valves associated with the second nozzle of each nozzle set and close all of the valves associated with the first nozzle of each nozzle set; or (c) open all of the valves associated with the first and second nozzles of each nozzle set;

depending on the travel speed of the paving machine.

11. The spray assembly of claim 8 wherein the means for intercepting at least a portion of the spray from a nozzle set of the second spray bar comprises:

(a) a collector pan that is mounted for linear movement along the first spray bar under a nozzle set of the second spray bar;

(b) a linear actuator for moving the collector pan along at least a portion of the first spray bar;

(c) a control mechanism that is operatively connected to the linear actuator in order to move the collector pan so that it intercepts at least a portion of the spray from a nozzle set of the second spray bar to prevent the spray pattern from said nozzle set from overlapping with the spray pattern from a nozzle set of the first spray bar.

12. The spray assembly of claim 11 wherein:

(a) the nozzle sets of the second spray bar are spaced along the second spray bar by an equal spacing amount;

(b) the collector pan has a length measured along the first spray bar that is approximately equal to the spacing amount of the nozzle sets of the second spray bar.

13. The spray assembly of claim 11 which includes a pump mounted on the collector pan and fluid circuitry between the pump and the source of fluid material, said pump being adapted to pump fluid material collected in the collector pan back to the source.

14. The spray assembly of claim 11, wherein the control mechanism comprises:

(a) a first sensor for detecting the relative position of the first spray bar with respect to the second spray bar;

(b) a second sensor for detecting the relative position of the collector pan on the first spray bar;

(c) an overspray controller that is operatively connected to the linear actuator in order to move the collector pan so that it intercepts at least a portion of the spray from a nozzle set of the second spray bar to prevent the spray pattern from said nozzle set from overlapping with the spray pattern from a nozzle set of the first spray bar.

15. The spray assembly of claim 11, wherein the control mechanism comprises:

(a) a first sensor for detecting the relative position of the first spray bar with respect to the second spray bar;

(b) a second sensor for detecting the relative position of the collector pan on the first spray bar;

(c) an overspray controller:

(i) that is operatively connected to the linear actuator in order to move the collector pan so that it intercepts at least a portion of the spray from a nozzle set of the second spray bar to prevent the spray pattern from said nozzle set from overlapping with the spray pattern from a nozzle set of the first spray bar; and (ii) that is operatively connected to the valves associated with the nozzles of a nozzle set of the second spray bar in order to close said valves.

16. The spray assembly of claim 8:

(a) wherein each of the nozzle sets of the first spray bar includes:

(i) a first nozzle which is adapted to dispense a fluid material in a first spray pattern onto the surface, said first nozzle having a valve associated therewith that can be opened or closed;

(ii) a second nozzle which is adapted to dispense a fluid material in a second spray pattern onto the surface, said second nozzle being disposed behind the first nozzle and having a valve associated therewith that can be opened or closed;

(iii) a third nozzle which is adapted to dispense a fluid material in a third spray pattern onto the surface, said third nozzle being disposed behind the first and second nozzles and having a valve associated therewith that can be opened or closed;

(b) wherein each of the nozzle sets of the second spray bar includes:

(i) a first nozzle which is adapted to dispense a fluid material in a first spray pattern onto the surface, said first nozzle having a valve associated therewith that can be opened or closed;

(ii) a second nozzle which is adapted to dispense a fluid material in a second spray pattern onto the surface, said second nozzle being disposed behind the first nozzle and having a valve associated therewith that can be opened or closed;

(iii) a third nozzle which is adapted to dispense a fluid material in a third spray pattern onto the surface, said third nozzle being disposed behind the first and second nozzles and having a valve associated therewith that can be opened or closed;

(c) which includes means for selectively opening or closing the valves associated the nozzles of each nozzle set.

17. The spray assembly of claim 16 which includes a tack application controller that is adapted to:

(a) open all of the valves associated with the first nozzle of each nozzle set and close all of the valves associated with the second and third nozzles of each nozzle set; or (b) open all of the valves associated with the second nozzle of each nozzle set and close all of the valves associated with the first and third nozzles of each nozzle set; or (c) open all of the valves associated with the third nozzle of each nozzle set and close all of the valves associated with the first and second nozzles of each nozzle set; or (d) open all of the valves associated with the first and second nozzles of each nozzle set and close all of the valves associated with the third nozzles of each nozzle set; or (e) open all of the valves associated with the first and third nozzles of each nozzle set and close all of the valves associated with the second nozzles of each nozzle set; or (f) open all of the valves associated with the second and third nozzles of each nozzle set and close all of the valves associated with the first nozzles of each nozzle set;

(g) open all of the valves associated with the first, second and third nozzles of each nozzle set;

depending on the travel speed of the paving machine.

* * * * *